US005388902A

United States Patent [19]

Huebschen et al.

[11] Patent Number: 5,388,902

[45] Date of Patent: Feb. 14, 1995

[54] SLIDING LATCH MECHANISM FOR A CABINET DRAWER

[75] Inventors: David A. Huebschen, Kenosha; Kenneth C. Happ, Burlington, both of Wis.

[73] Assignee: Snap-on Incorporated, Kenosha, Wis.

[21] Appl. No.: 82,765

[22] Filed: Jun. 25, 1993

Related U.S. Application Data

[63] Continuation-in-part of Ser. No. 11,985, Feb. 1, 1993.

[51] Int. Cl.[6] ..... A47B 88/00

[52] U.S. Cl. ..... 312/332; 312/330.1; 312/333

[58] Field of Search ..... 312/319.1, 330.1, 332.1, 312/333, 334.46; 292/163, 175, DIG. 38, 76, 86

[56] References Cited

U.S. PATENT DOCUMENTS

| | | | |
|---|---|---|---|
| Re. 28,280 | 12/1974 | Aleks . | |
| 1,453,121 | 11/1920 | Benner . | |
| 1,897,080 | 2/1933 | Soper | 312/332.1 X |
| 1,934,397 | 11/1933 | Bales et al. | 312/332.1 X |
| 2,689,777 | 9/1954 | Wolters . | |
| 3,031,248 | 4/1962 | Jeeves . | |
| 3,245,744 | 4/1966 | Olson . | |
| 3,450,453 | 6/1969 | Tazaki . | |
| 3,469,875 | 9/1969 | Ahlgren . | |
| 4,320,834 | 3/1982 | Tamaki | 292/175 X |
| 4,653,820 | 3/1987 | Tazaki . | |
| 4,790,579 | 12/1988 | Maxwell et al. . | |

FOREIGN PATENT DOCUMENTS

| | | |
|---|---|---|
| 0511918 | 11/1992 | European Pat. Off. . |
| 204469 | 12/1981 | Taiwan, Prov. of China . |
| 214062 | 6/1982 | Taiwan, Prov. of China . |

OTHER PUBLICATIONS

Catalog of Lista International Corporation, cover and p. 17.
File Cabinet (photos of).
Drawer (photos of).
Equipto cabinet (photos of).
Bott cabinet (photos of).

*Primary Examiner*—Brian K. Green
*Attorney, Agent, or Firm*—Emrich & Dithmar

[57] ABSTRACT

The latch mechanism includes a drawer pull at the front of the drawer. Under the top flange of the drawer pull is a channel in which a latch member is slidably movable from side to side. A hook is integral with one end of the latch member, which is spring loaded to its latched position. When it is desired to open the drawer, the user places his fingertips beneath the pull and against the latch member and moves the slide member to its unlatched position.

11 Claims, 1 Drawing Sheet

SLIDING LATCH MECHANISM FOR A CABINET DRAWER

REFERENCE TO RELATED APPLICATION

This is a continuation-in-part of application Ser. No. 08/11,985, filed Feb. 1, 1993.

BACKGROUND OF THE INVENTION

Cabinets with drawers are constructed so that each drawer either automatically latches when closed or requires positive operation of an actuator to be latched. Drawers in filing cabinets are usually of the former character, while drawers in rolling cabinets in the marketplace must be positively actuated to latch them closed. The present application deals with a latch mechanism that is placed in its latched position automatically when the drawer is closed. It should be understood that latch mechanisms are separate from key-operated locks that may be included in cabinets. This application deals with the former, not locks.

In most latch mechanisms, the actuator is pivoted or rotated between its latched and unlatched conditions. When the cabinet is of the rolling type, that is, it is moved from place to place on its rollers, such latch mechanisms tend to inadvertently open, particularly if the floor is uneven. Known mechanisms incorporating a sliding structure have an actuator which is grasped by the user at a particular point to open it. When the pull extends across the drawer, it is more difficult to use if the user is required to grasp it at only one point.

Certain known drawer latch mechanisms require the use of two hands, one to unlatch the mechanism and the other to grasp the drawer pull and open the drawer. Also, they are unsightly because their actuators are visible.

The above-identified patent application discloses a sliding latch mechanism for a cabinet drawer comprising a drawer latch mechanism which is less likely to open inadvertently when the cabinet in which it is used is rolled from one place to another. The user can grasp the latch mechanism at any point along its extent to open the drawer. The drawer latch mechanism is substantially concealed by the drawer pull. That mechanism can be unlatched and the drawer opened with one hand.

SUMMARY OF THE INVENTION

It is an important object of the present invention to provide a drawer latch mechanism of the type disclosed in the above-identified patent application, but which is an improvement thereof.

Another object is to provide a drawer latch mechanism of the type disclosed in said patent application, but which is of one-piece construction.

In summary there is provided a latch mechanism for a drawer of a cabinet including sidewalls, the drawer including an elongated drawer pull, the latch mechanism comprising an elongated slide member under the pull and slidable between latched and unlatched positions, a hook at one end of the member and integral therewith, a keeper on the adjacent one of the sidewalls of the cabinet adjacent to the hook, the hook being arranged to engage the keeper when the slide member is in its latched position and to be disengaged from the keeper when the slide member is in its unlatched position.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF A PREFERRED EMBODIMENT

Figure 1:
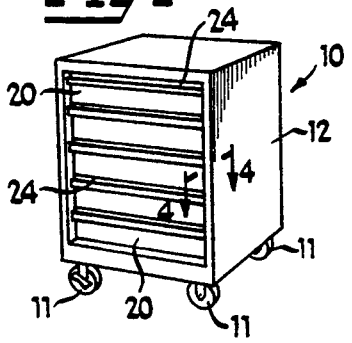
FIG. 1 is a perspective view of a cabinet containing a plurality of drawers.
Figure 2:
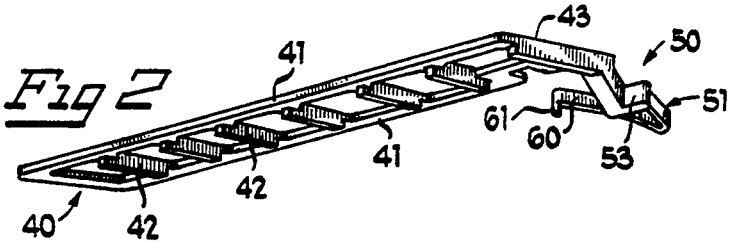
FIG. 2 is a perspective view of the slide member used in the drawer latch mechanism constructed in accordance with the features of the present invention.
Figure 3:
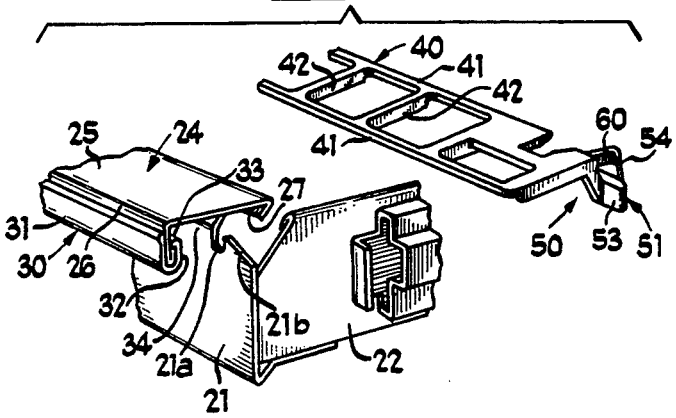
FIG. 3 is an exploded, perspective, fragmentary view, on an enlarged scale, of one of the latch mechanisms in the cabinet of FIG. 1.

Turning now to the drawings, and, more particularly, to FIG. 1 thereof, there is depicted a tool storage cabinet mounted on rollers 11. The cabinet 10 includes two sidewalls 12 and a plurality of drawers 20. An elongated metal drawer pull 24 is located at the front end of each of the drawers and extends along its entire length.

Referring to the rest of the drawings, each drawer 20 has a front wall 21 and a pair of sidewalls 22. Each drawer has a pull 24 which is actually integral with front wall 21. Pull 24 includes a top flange 25 and a depending front flange 26. Front wall 21 is bent rearwardly at its upper end to form an offset portion 27.

Associated with each drawer is a trim member 30 which is U-shaped in cross section, having a front element 31 and a rear element 32. Near the top of the rear element 32 is a forwardly projecting rib 33. Because of the convergence of elements 31 and 32 and their resilience, front flange 26 is tightly gripped between element 31 and rib 33. The space between rib 33 and top flange 25 at the front and the space defined by offset portion 27 at the rear, define a channel 34.

A latch member 40 is elongated and has a length substantially equal to the length of pull 24, a width slightly less than the width of top flange 25 and a thickness slightly less than the height of channel 34. Latch member 40 is of ladder construction and includes two longitudinally extending rails 41 and a plurality of parallel cross members or fingers 42. Each finger 42, in the embodiment depicted, has a length less than the width of member 40. Each finger 42 depends so as to be engageable by a user's finger. Latch member 40 is located in channel 34 and rests upon rib 33 at the front and upon offset portion 27 at the rear. Latch member 40 is constrained between top flange 25, rib 33 and offset portion 27 and is horizontally slidable within channel 34 from side to side.

Each drawer 20 also has a latch 50 which includes a hook 51 unitary with member 40. Hook 51 has a shoulder 53 and a camming surface 54. A leaf spring 60 is an extension of hook 51 and is integral therewith. A tab 61 is formed on the end of spring 60. Member 40, hook 50 and spring 60 are molded of a single piece of plastic. The free end of leaf spring 60 resides in a notch 21*a* of front wall 21. When in place, tab 61 prevents spring 60 from becoming dislodged from notch 21*a*.

Latch member 40 is movable between latching and unlatching positions. Spring 60 biases member 40 to the right, as viewed in FIG. 7, and to its latched condition. One may place one's fingers under drawer pull 24 and touch latch member 40. By moving one's hand to the left, one or more depending fingers 42 are engaged and latch member 40 is moved to the left to move it to its unlatched position.

Figure 4:
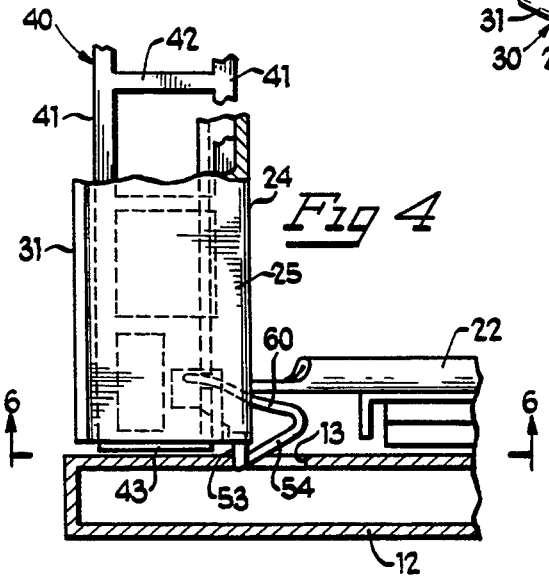
FIG. 4 is a fragmentary sectional view of the latch mechanism in its latched condition, on an enlarged scale, taken along the line 4—4 of FIG. 1.
Figure 6:
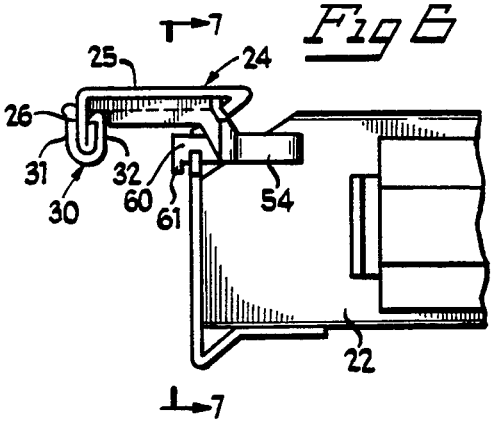
FIG. 6 is a fragmentary view in vertical section taken along the line 6—6 of FIG. 4.

Referring to FIG. 4, whenever drawer 20 is in its closed position, hook 51 occupies the position shown, that is, it is in a keeper opening 13 of cabinet sidewall 12. Shoulder 53 is in facing relationship with the front of opening 13, thereby placing drawer 20 in its latched condition.

Figure 5:
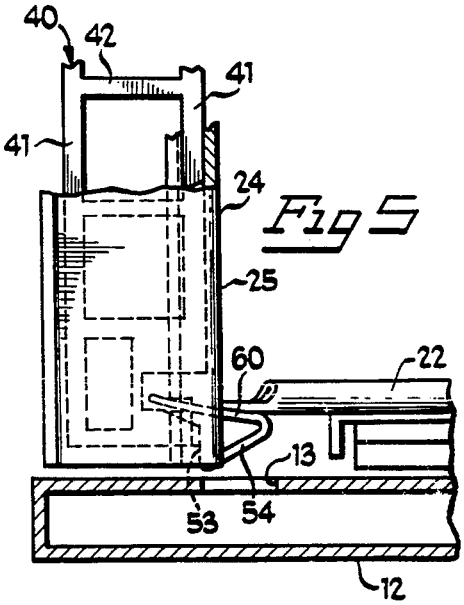
FIG. 5 is a view like FIG. 4, but with the latch mechanism in its unlatched condition.

When it is desired to open the drawer, the user places his fingers under pull 24 of the associated drawer whereby his finger tips will contact latch member 40 as above described. Movement to the left will cause the finger tips to engage fingers 42 and move latch member 40 to the left, causing hook 51 to be withdrawn from opening 13, as depicted in FIG. 5. Now the user, with his fingers against rear element 32 of trim member 30, pulls the drawer open. Latch member 40 will automatically snap back to the right as soon as the user releases it, by virtue of spring 60 urging latch member 40 to the right. When the drawer is later closed, camming surface 54 engages the front of the sidewall 12 depicted, causing hook 51 to automatically move to the left thereby clearing sidewall 12, whereupon the drawer can be closed. Spring 60 will cause hook 51 to snap to the right, to the latched position depicted in FIG. 4.

Cabinet 10 is on wheels and is adapted to be moved from place to place. It is important that, when the cabinet is being moved, the drawers 20 be securely latched closed, so that they do not open inadvertently. The mechanism described above is secure. The bouncing motion which would occur if the floor on which the cabinet is being rolled is uneven would tend to unlatch a latch mechanism having an actuator that is pivoted vertically. Such bouncing would have much less of an effect on the horizontally movable latch 50 described above. Moreover, the latch member 40 is concealed. It is not visible in FIG. 1 to spoil the cabinet's appearance. It is constrained by the drawer pull itself so that it is automatically engaged by the user who wants to open a drawer. The member 40 can be touched at any point along the drawer.

Figure 7:
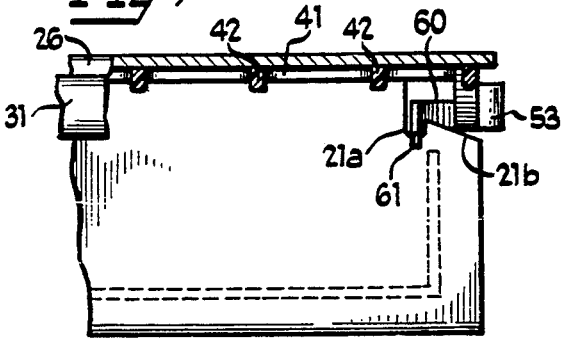
FIG. 7 is a view in vertical section taken along the line 7—7 of FIG. 6.

To assemble the latch mechanism, member 40 is aligned with channel 34 of drawer 20. It is then slid into place until spring 60 contacts a ramp 21*b* of front wall 21 (FIG. 7). Spring 60 rides up that ramp until it snaps down into notch 21*a* where it is retained by tab 61.

As can be seen in FIG. 4, end 43 of member 40 is visible when member 40 is in its latched position. This provides a visual indication to the user of the condition of the drawer. If he does not see end 43, that means that the drawer is not in its latched position. He will know then to push the drawer closed. The user can readily look at a bank of drawers and determine if any of them are not closed.

What is claimed is:

1. A cabinet comprising:

a pair of spaced-apart side walls, a drawer disposed between said side walls, an elongated drawer pull on said drawer, an elongated slide member disposed under said drawer pull and extending longitudinally thereof and supported thereby for sliding movement longitudinally thereof between latching and unlatching positions, a latch hook unitary with said slide member at one end thereof adjacent to one of said side walls, a keeper on said one side wall adjacent to said drawer, and spring means unitary with Said hook and biasing said slide member to its latching position, said hook being engageable with said keeper when said slide member is in its latching position and being disengaged from said keeper when said slide member is in its unlatching position.

2. The cabinet of claim 1, wherein said slide member has a plurality of depending fingers.

3. The cabinet of claim 2, wherein said fingers are elongated and substantially parallel.

4. The cabinet of claim 3, wherein said slide member has a width, each of said fingers being shorter than the width of said slide member.

5. The cabinet of claim 2, wherein said elongated slide member is of ladder construction, including two elongated rails and a plurality of cross members defining said fingers.

6. The cabinet of claim 1, wherein said drawer includes a front wall having a notch therein, said spring means residing in said notch.

7. The cabinet of claim 6, wherein said front wall has a ramp communicating with said notch, said spring means riding on said ramp into said notch during assembly of said slid member into the drawer.

8. The cabinet of claim 6, wherein said spring means carries a tab to prevent inadvertent dislodgement of said spring means from said notch.

9. The cabinet of claim 1, wherein said slide member has a portion protruding laterally from said drawer when said slide member is in the latching position thereof and being concealed when said slide member is in the unlatching position thereof.

10. The cabinet of claim 1, wherein said side walls are spaced apart a predetermined distance, said drawer having a width slightly less than said predetermined distance, said drawer pull and said slide member extending substantially the width of said drawer.

11. The cabinet of claim 1, wherein said hook includes a cam surface disposed for camming engagement with said one side wall when said drawer is moved from an open condition to a closed condition for moving said latch hook to its unlatching position against the urging of said bias means.

* * * * *